US005251690A

United States Patent [19]

Otake et al.

[11] Patent Number: 5,251,690

[45] Date of Patent: Oct. 12, 1993

[54] APPARATUS FOR COLLECTING CLEANING BODIES FOR TUBULAR HEAT EXCHANGER

[75] Inventors: Katsumoto Otake; Yoshio Sumiya, both of Hitachi; Yasuo Fujitani, Ibaraki; Shigeo Oda, Hitachi; Tokunori Matsushima, Ibaraki; Takuya Sasaki; Keizo Ishida, both of Hitachi; Hideki Kon; Hiroshi Satoh, both of Yokosuka; Toshihiko Kaneko; Makoto Yanagihara, both of Yokohama, all of Japan

[73] Assignees: Hitachi, Ltd., Tokyo; Hitachi Machinery and Engineering, Ltd., Kanagawa, both of Japan

[21] Appl. No.: 699,608

[22] Filed: May 14, 1991

[30] Foreign Application Priority Data

May 14, 1990 [JP] Japan ..... 2-121161
Mar. 20, 1991 [JP] Japan ..... 3-057067

[51] Int. Cl.[5] ..... F28G 1/12
[52] U.S. Cl. ..... 165/95; 15/3.51
[58] Field of Search ..... 165/95; 15/3.51

[56] References Cited

U.S. PATENT DOCUMENTS 4,539,115 9/1985 Patzig ..... 210/409

FOREIGN PATENT DOCUMENTS 3131124 10/1982 Fed. Rep. of Germany .
3622396 1/1988 Fed. Rep. of Germany .
57-19599 2/1982 Japan ..... 165/95
58-186411 10/1983 Japan .
58208598 3/1984 Japan .
60-64197 4/1985 Japan ..... 165/95
61-165596 7/1986 Japan ..... 165/95
62-192098 12/1987 Japan .
63-180094 7/1988 Japan ..... 165/95
1021442 3/1966 United Kingdom .

*Primary Examiner*—Allen J. Flanigan
*Attorney, Agent, or Firm*—Antonelli, Terry, Stout & Kraus

[57] ABSTRACT

An apparatus for collecting cleaning bodies in a tubular heat exchanger capable of collecting the cleaning bodies with a high collection efficiency against the temporary introduction of a large amount foreign matter such as falling tools in a cooling water system and against the deflected flow of the cooling water from the upstream side. A rectifying member rectifies or regulates the deflected flow of the cooling water from the upstream side whereby it is possible to collect the cleaning bodies without any adhesion and stagnation of the cleaning bodies in the cooling water on V-shaped collection lattices. It is also possible to trap a large article such as a falling tool between a guide member disposed downstream of the collection lattices and the collection lattices, and to introduce only the cleaning bodies into the guide member. Furthermore, the downstream port of a cleaning body discharge pipe opens toward the downstream side to thereby prevent the clogging of the port with the foreign matter or the like.

11 Claims, 17 Drawing Sheets

APPARATUS FOR COLLECTING CLEANING BODIES FOR TUBULAR HEAT EXCHANGER

BACKGROUND OF THE INVENTION

The present invention relates to an apparatus for collecting cleaning bodies for a tubular heat exchanger, in which cleaning bodies such as sponge balls are introduced into cooling water to wash or clean the interior of heat transfer pipes of the heat exchanger, and the cleaning sponge balls are efficiently collected.

In, for example, Japanese Patent Unexamined Publication No. 58-186411 a cleaning body collecting apparatus for a tubular heat exchanger is proposed wherein a lower portion of a collection lattice is formed into a collection container, an obliquely extending guide member is provided in the region of an end wall of the collection container, and the width of the guide member is narrower than a distance between side walls of the collection container. The guide member is directed toward a cleaning member outlet, with the cleaning member being separated from the cooling water.

In Japanese Utility Model Unexamined Publication 62-19298 an apparatus is proposed wherein a cleaning body extracting pipe for absorbing the cleaning bodies collected at a downstream and of a lattice is disposed in a space defined by the collection lattice.

With respect to the former prior art apparatus, no means are provided for rectifying a deflected flow, from the upstream side, for the inlet side of a cylindrical casing. Consequently, it is difficult to stably collect the cleaning bodies since the cleaning bodies would be stuck to or stagnate in the lattice.

In addition, when a large amount of foreign matter is temporarily introduced into the apparatus, it is impossible to prevent the introduction of the foreign matter between the guide member and the side wall of the container. Accordingly, the foreign matter would clog an open end of the cleaning body extracting pipe located on the lower side and facing downstream, so that the collection efficiency of the cleaning bodies would be decreased.

The latter prior art apparatus suffers from a problem that it is difficult to stably collect the cleaning bodies, since the cleaning bodies would be stuck to or stagnate in the lattice due to fact that there is no means for rectifying or regulating the deflected flow at the inlet side of the cylinder with respect to the deflected flow from the upstream side.

In addition, when a large amount of foreign matter is temporarily introduced, since there is no means for preventing the introduction of the foreign matter, the foreign matter or the like would clog the opening portion of the cleaning body extracting pipe located on the upper side and facing upstream, thus reducing the cleaning body collecting performance.

SUMMARY OF THE INVENTION

An object of the present invention is to provide an apparatus for collecting cleaning bodies for a tubular heat exchanger, which is capable of collecting cleaning bodies in a stable manner with a high collection efficiency without any clogging of the open end of a cleaning body discharge pipe with foreign matter even if a large amount of foreign matter is introduced into the apparatus.

In order to attain this and other objects, according to the invention, there is provided an apparatus for collecting cleaning bodies for a tubular heat exchanger which includes a V-shaped collection lattice means having upstream sides thereto diverging toward a cooling water passage for collecting the cleaning bodies contained in the cooling water, with a cleaning body discharge means discharging the cleaning bodies trapped by the collection lattice means outside of the cooling water passage. A flow rectifying means divides the cooling water passage between the collection lattice means for rectifying a deflected flow from the upstream side, with a guide means, fixed to a downstream end portion of the flow rectifying means, guiding the cleaning bodies into the cleaning body discharge means through an interior partitioned from the cooling water passage. The cleaning body discharge means is fixed at its downstream end to the guide means and is opened at its end toward the downstream side.

The collection lattice means is pivotally provided in the apparatus.

The guide means includes a vane fixed so that a central portion located on the most downstream side is fixed to a downstream end portion of the flow rectifying member, with both sides thereof extending obliquely in the upstream direction. A downstream end of the cleaning body discharge means is opened toward the downstream side at the central portion, and a cleaning body guide is formed substantially in parallel with the vane at an interval relative to the vane, which interval is greater than a diameter of the cleaning bodies but less than a diameter of foreign matter or the like, with the cleaning body guide being provided downstream of the vane.

The vane and the duct have an increased width toward the ends thereof.

The guide means includes a downwardly facing suction box fixed to the downstream end portion of the flow rectifying means, with the box being open at the downstream side thereof, and with a bottom of the box being located the central portion, and both sides being slanted obliquely on the downstream side. A cleaning body guide is formed substantially in parallel with a downstream end face of the downwardly facing suction box at an interval greater than a diameter of the cleaning body but less than a diameter of foreign matter or the like.

The guide means includes a water injection pipe opened toward the upstream side between the downwardly facing suction box and the cleaning body guide.

The downwardly facing suction box includes a flange fixed to an outer portion of a widthwise downstream end portion of the downwardly facing suction box, with a tip end portion of the flange extending toward the collection lattice means.

The guide means includes a flow rectifying plate disposed between the downwardly facing suction box and the cleaning body guide for introducing the cleaning bodies into the reverse absorption box.

According to the present invention, an apparatus for collecting cleaning bodies for a tubular heat exchanger is provided which includes a V-shaped collection lattice means with upstream sides thereof and opening in a direction of a cooling water passage for collecting the cleaning bodies in a cooling water. A cleaning body discharge means discharges the cleaning bodies trapped by the collection lattice means to an outside of the cooling water passage. At least one partitioning plate partitions the cooling water passage into a plurality of chambers in dependence upon a size of the cooling water passage. The collection lattice means includes a plurality of collection lattices for collecting the cleaning bodies introduced from the upstream side into the respective chambers, with a plurality of flow rectifying means dividing each cooling water passage between the collection lattice means for rectifying a deflected flow from the upstream side. A guide means, fixed to downstream end portions of the plurality of flow rectifying means, guides the cleaning bodies into the cleaning body discharge means through a partitioned interior of the cooling water passage, with the cleaning body discharge means including a plurality of cleaning body discharge plate, each being fixed at its downstream end to the guide means and being opened at its tip end opening portion toward the downstream side.

The guide means includes a vane and a at least one guide plate, with the vane being wave shaped so that downstream end portions of the plurality of cleaning body discharge pipes are located on the downstream side.

The guide plate is wave shaped so that the position of the guide plate facing a downstream tip opening portion of the plurality of cleaning body discharge pipes is located on the downstream side.

DETAILED DESCRIPTION OF THE PREFERRED EMBODIMENTS

Figure 1:
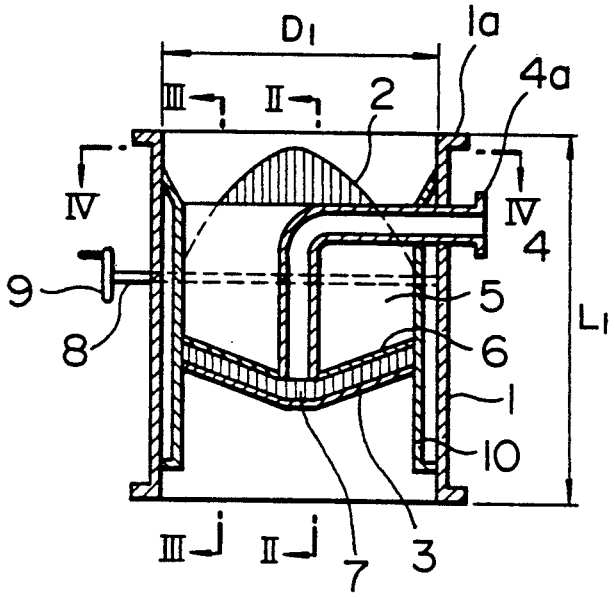
FIG. 1 is a longitudinal sectional view of one embodiment of an apparatus for collecting cleaning bodies in a tabular heat exchanger constructed in accordance with the present invention.
Figure 2:
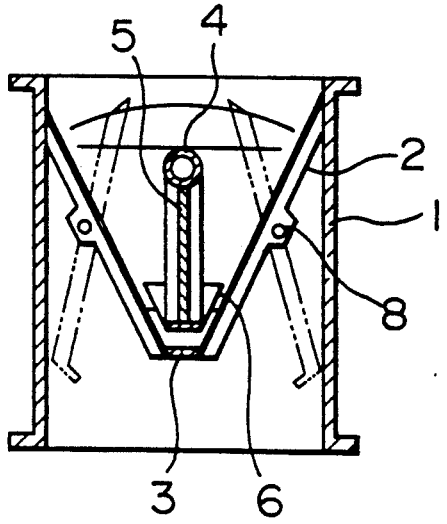
FIG. 2 is a sectional view taken along the line II—II of FIG. 1.
Figure 3:
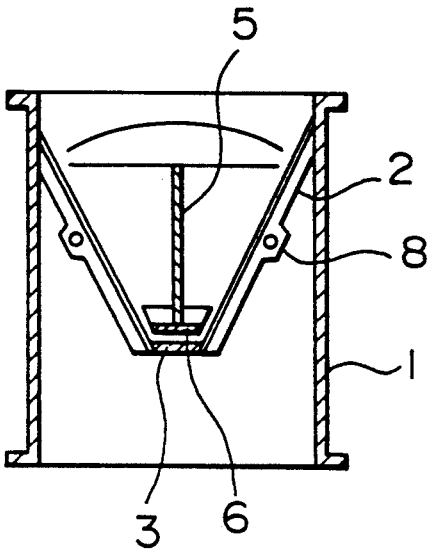
FIG. 3 is a sectional view taken along the line III—III of FIG. 1.
Figure 4:
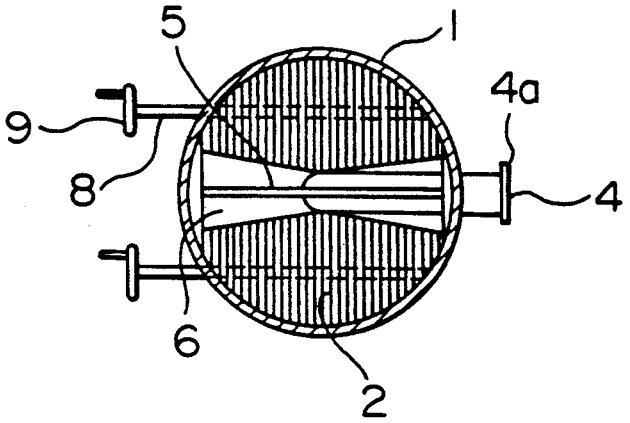
FIG. 4 is a sectional view taken along the line IV—IV of FIG. 1.

As shown in FIGS. 1-6, a cleaning body collecting apparatus according to the invention includes a cylindrical barrel 1, a collection lattice 2, a cleaning body discharge pipe 4, a rectifying or regulating member 5, a cleaning body guide 3 and a vane 6 serving as a guide member.

Figure 5:
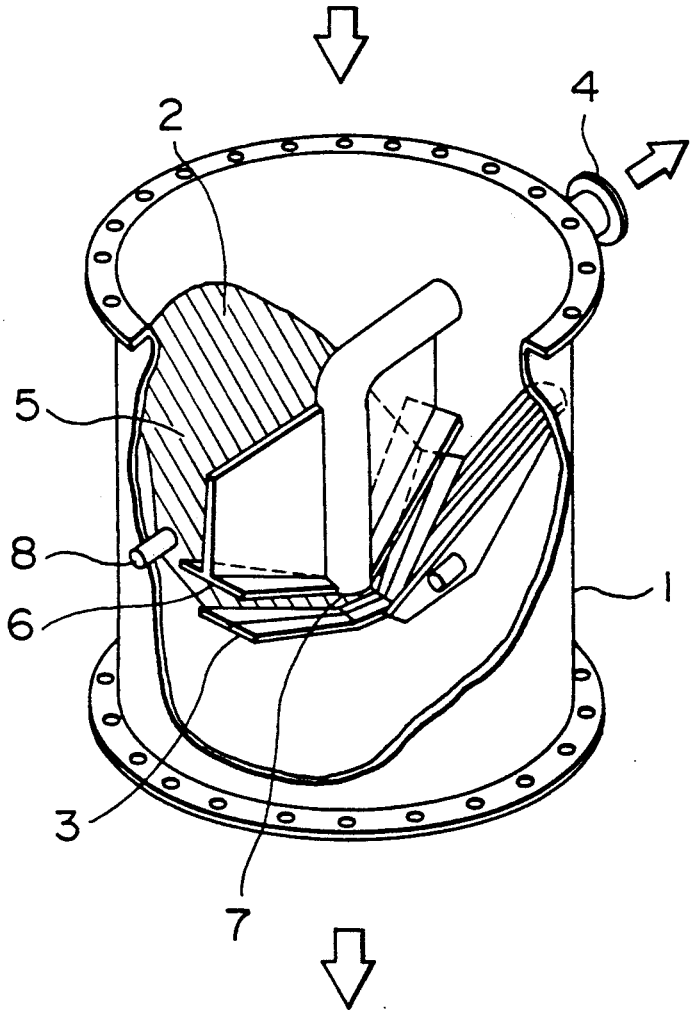
FIG. 5 is a partially fragmentary perspective view of the apparatus of FIG. 1.
Figure 6:
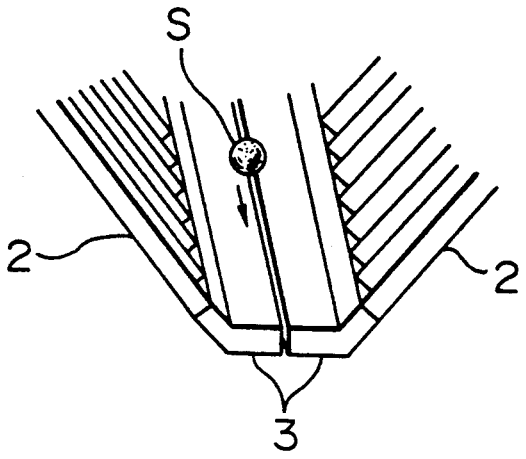
FIG. 6 is an enlarged perspective view showing a duct used in the apparatus shown in FIG. 1.

A flange 1*a* of the cylindrical barrel 1 is connected with a cooling water pipe extending from a condenser (not shown) by a coupling means such as welding. The cleaning body discharge pipe 4 is disposed along an axial line of the barrel 1 and, at an upstream portion is bent at a right angle with its tip end portion extending outside of the barrel 1. A flange 4*a* for connection with a recirculation system (not shown) is fixed to the tip end portion of the discharge pipe 4. An opening 7 is formed at a downstream tip end portion of the cleaning body discharge pipe 4 so as to open toward the downstream side at the space defined between the vane 6 and the cleaning body guide 3. The guide 3 is composed of a pair of guide members as best shown in FIG. 6, with each guide member having an L-shaped cross section. A portion, located at the most downstream side, of a central portion of each guide member is disposed to face the downstream opening portion 7 of the cleaning body discharge pipe 4. The guide members extend on both sides obliquely upwardly with its width increasing toward the upper ends, respectively. Edges of both of the guide members are fixed to downstream end portions of the collecting lattices 2 as best shown in FIG. 5. The reason why the width of the guide members of the guide 3 is increased on both sides toward the upper ends is that, since both sides of the cleaning body guide 3 extend obliquely upwardly, if the width of the duct members of the duct 3 were constant, it would be difficult to securely couple the side edges of the guide members of the cleaning body guide 3 and the downstream end portions of the collection lattices 2 with each other. The flow rectifying or regulating member 5 is disposed along the axial line of the cylindrical barrel 1 so as to substantially divide the cooling water passage into two halves. Both sides of the rectifying member 5 are fixed to vertical planar plates 10. The rectifying member 5 is fixed at the central portion of the cleaning body discharge pipe 4. The vane 6 is fixed to the downstream portion of the rectifying member 5, and is extended obliquely upwardly on both sides at the same slant angle as that of the cleaning body guide 3 so as to keep a space in cooperation with the cleaning body guide 3, with its width increasing toward the upper end portions. The uppermost ends of the vane 6 are fixed to the vertical planar plates 10. It should be noted that the space has an interval greater than a diameter of cleaning balls S but less than a diameter of relatively large foreign matter such as, for example, falling material from the cooling water discharging pipe. It is also noted that a constant interval is maintained between the side edges of the vanes 6 on both sides and the downstream ends of the collection lattices 2. The lattice 2 includes a pair of lattice members, each of which has a number of crosspieces arranged at a predetermined interval to be perpendicular to the flow direction of the cooling water. The downstream end of each lattice member is fixed to the side edge portions of each guide member of the cleaning body guide 3 and to face the side edge of the vane 6 at a predetermined interval. When the upstream end portions of the lattice members 2 are located at positions shown in FIG. 2, the lattice members are brought substantially in contact with an inner surface of the cylindrical barrel 1. A shaft 8 is disposed on each side so that the collection lattice 2 may hold the number of crosspieces in unison. The shaft 8 is rotatably supported to the cylindrical barrel 1. A handle 9 is fixed to the other end portion of a shaft 8 passing through the cylindrical barrel 1.

The cooling water, having cleaning bodies S, which have passed through heat transfer tubes of the condenser to complete the cleaning, is introduced from the upstream side of the cylindrical barrel 1 through the cooling water discharging pipe. Then the cleaning bodies S collide with the collection lattice member 2 pivoted into the position indicated by the solid lines in FIG. 2 by rotating the handle 9. The cleaning bodies S fall down by the gravitational force along the slanted crosspieces to the cleaning body guide 3.

Thereafter, the cleaning bodies S are moved between a space between the cleaning body guide 3 and the vane 6 along both the slanted surfaces of the cleaning body guide 3 and reach the most downstream position of the central portion of the cleaning body guide 3. The cleaning bodies S are absorbed therefrom through the opening portion 7 into the cleaning body discharge pipe 4 and are collected through the cleaning body discharge pipe 4 to a predetermined position.

On the other hand, when a large amount of foreign matter is introduced into the apparatus from the cooling water discharging pipe, if the size of the foreign matter is larger than the interval between both the ends of the vane 6 and the downstream edges of the collection lattices 2, the foreign matter is collected at the space between the vane 6 and the collection lattice member 2 but the cleaning bodies S are only allowed to enter the cleaning body guide 3 to be collected through the cleaning body discharge pipe 4.

Figure 7:
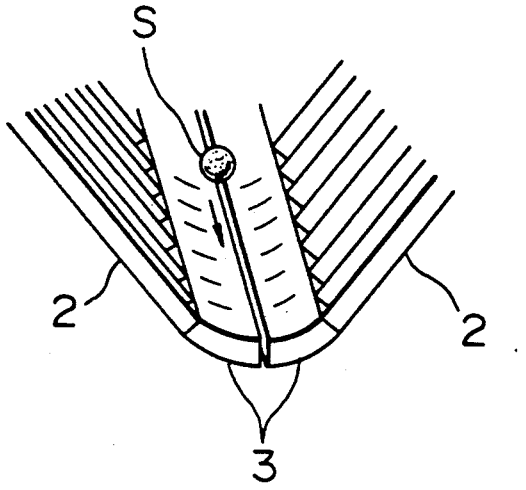
FIG. 7 is an enlarged perspective view of a duct in accordance with another embodiment of the invention.
Figure 8:
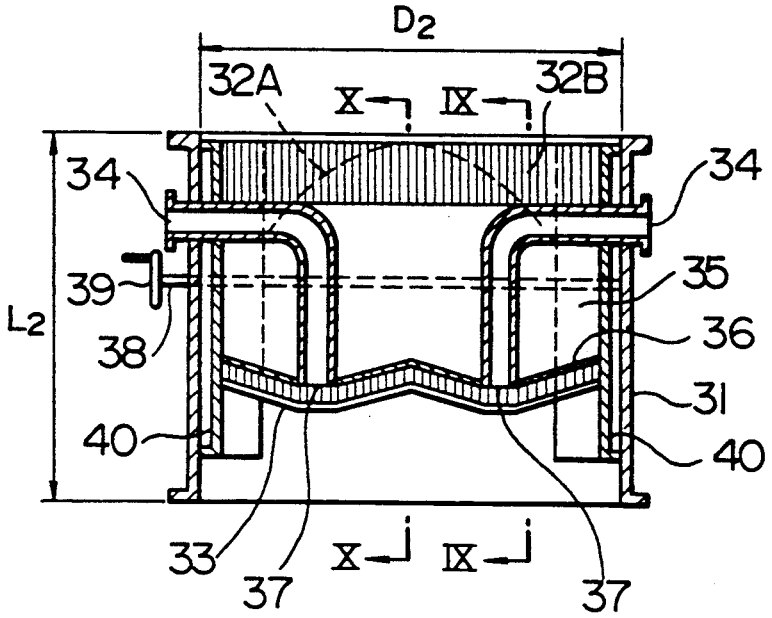
FIG. 8 is a longitudinal sectional view of yet another embodiment of the invention.
Figure 9:
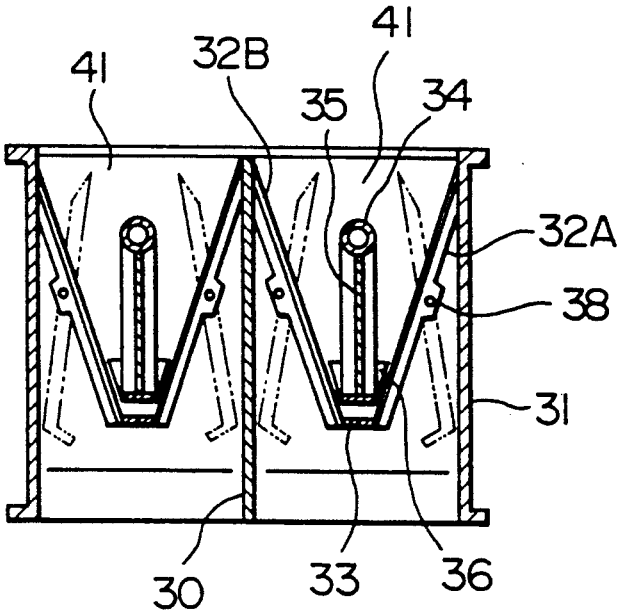
FIG. 9 is a sectional view taken along the line IX—IX of FIG. 8.
Figure 10:
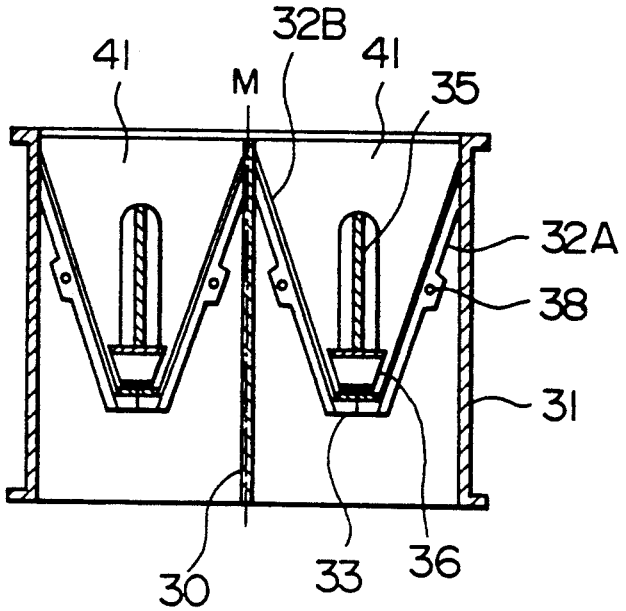
FIG. 10 is a sectional view taken along the line X—X of FIG. 8.
Figure 11:
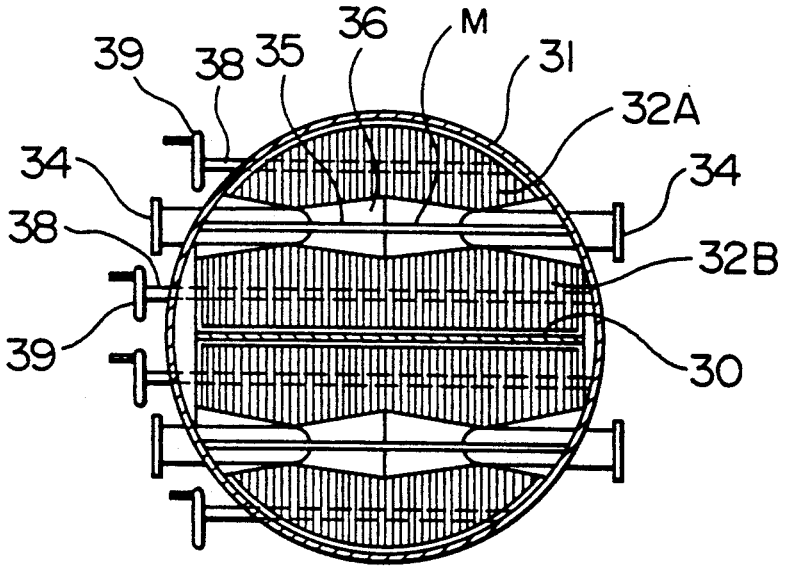
FIG. 11 is a cross-sectional view of the apparatus shown in FIG. 8.
Figure 12:
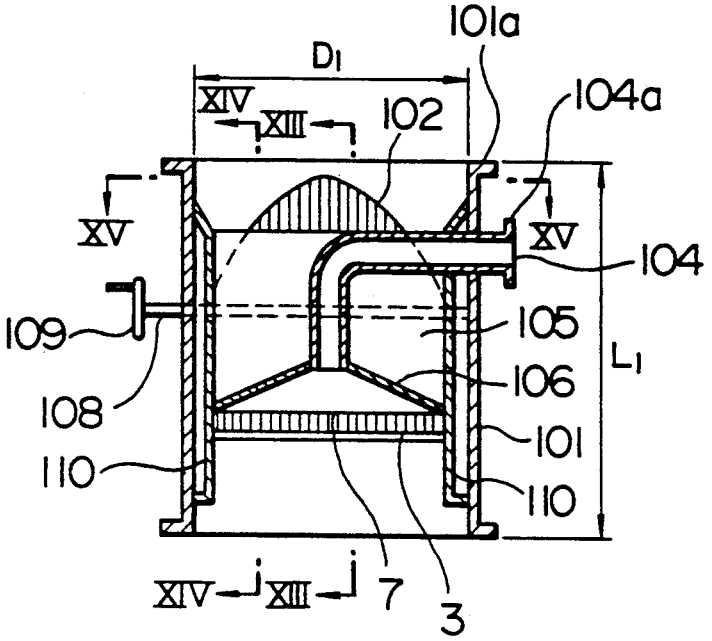
FIG. 12 is a longitudinal sectional view of another embodiment of the invention.

The cleaning body guide 3 shown in FIG. 7 has, in cross section, an arcuate shape with a concave central portion. Thus, the cleaning bodies S may readily be rolled and moved to ensure the collection onto the cleaning body discharge pipe 4.

In the embodiment of FIGS. 8 through 11, since a diameter $D_2$ of a barrel 31 is large, in the case where it takes the same structure as shown in FIGS. 1 through 6, the collection lattices are enlarged and the length of the barrel is increased. Thus, this embodiment is applicable to a compactness of the overall apparatus.

As shown in FIG. 8 through 11, a central portion of the barrel 31 is divided into two semi-cylindrical chambers 41 by a partitioning plate 30. A pair of collection lattices 32A and 32B are pivotably disposed about a shaft 38 in each chamber 41. The two pairs of the lattices are arranged so as to face each other on both sides of the centerlines M. A flow rectifying or regulating member 35 is provided along each centerline M. Each flow rectifying member 35 is fixed at a central portion to the cleaning body discharge pipe 34. Both side edge portions of the rectifying member 35 are fixed to a vertical planar plate 40. Vanes 36 are fixed to the downstream end portions of the rectifying plate 35. The vanes 36 are wave shaped so that the mounting positions of the downstream end opening portions 37 of the cleaning body discharge pipes 34 onto the vanes 36 are located on the downstream side. Both ends of the vanes 36 are fixed to the vertical planar plates 40. On the downstream side, the cleaning body guide 33 are arranged so as to have intervals, with the vanes 36, greater than a diameter of the cleaning bodies S but less than a diameter of a relatively large foreign matter. The cleaning body guide 33 are wave shaped in parallel with the vanes 36 so that the positions of the cleaning body guide 33 facing the downstream end opening portions 37 of the discharge pipes 34 are located on the downstream side. Both side edges of the cleaning body guide 33 are fixed to the downstream ends of the collection lattices 32A and 32B. The cleaning body collecting method is the same as that of the embodiment shown in FIGS. 1 to 6, and hence the explanation will be omitted herein.

The embodiment shown in FIGS. 12 to 16 is substantially the same as the embodiment shown in FIGS. 1 to 6 except for the difference in downwardly facing suction box 106 and 103 which form a guide member.

The downwardly facing suction box 106 is fixed to the downstream side of the rectifying member 105. On the downstream side, there is provided an opening portion 107 facing the cleaning body guide 103, and on the upstream side, the box 106 is box shaped in cross section with its width being kept constant and with a bottom being fixed to the downstream side of the rectifying member 105. The central portion of the bottom portion is located on the most upstream side for fixing the cleaning body discharge pipe 104 thereto so that its opening portion is directed toward the downstream side. Both sides of the bottom portion are obliquely downwardly slanted to assist and guide all the cleaning bodies S, introduced between the duct 103 and the bottom portion and spread in the transverse direction (in FIG. 12), to enter the downstream opening portion 107 of the cleaning body discharge pipe 104. A space is formed between the lower surface of the downwardly facing suction box 106 and the cleaning body guide 103, with the space being larger than a diameter of the cleaning bodies S but less than a diameter of a relatively large foreign matter introduced, such as, for example, a tool falling from the cooling water discharging tube. Further, the space between the side edges of the downwardly facing suction box 106 and the downstream ends of the collection lattices allows only the cleaning bodies S to pass therethrough. The cleaning body guide 103 includes a pair of guide elements in the same manner as shown in FIG. 6, with an L-shaped cross section. The respective guide members are arranged so as to face the downstream end opening portion 107 of the downwardly facing suction box 106 and extend in a horizontal direction with a constant width. The guide members are fixed to the downstream ends of the collection lattices 102. It is also possible to form the guide members of the cleaning body guide 103 to have an arcuate U-shaped cross section so that the cleaning bodies S may readily be rolled or moved along the arcuate shape to ensure the collection of the cleaning bodies S within the downwardly facing suction box 106.

Figure 13:
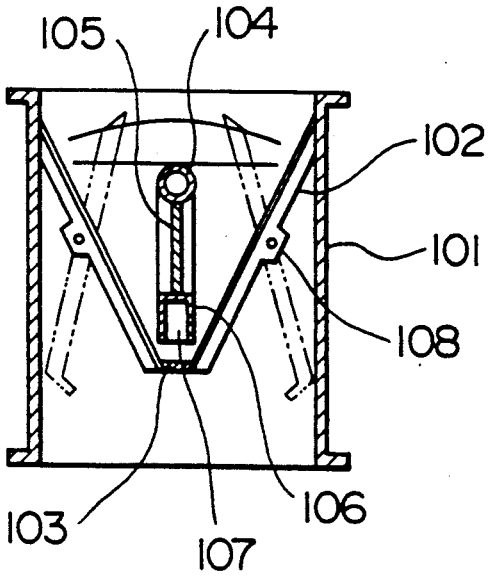
FIG. 13 is a sectional view taken along the line XIII—XIII of FIG. 12.
Figure 14:
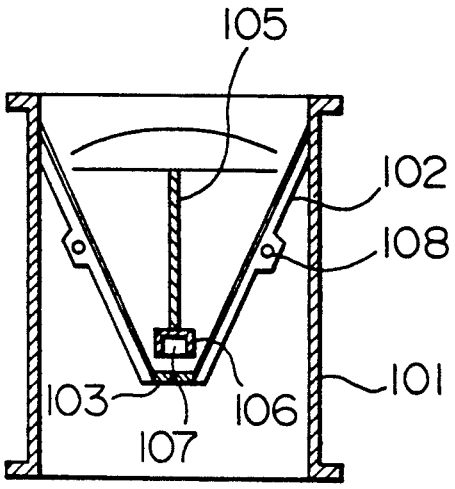
FIG. 14 is a sectional view taken along the line XIV—XIV of FIG. 12.
Figure 15:
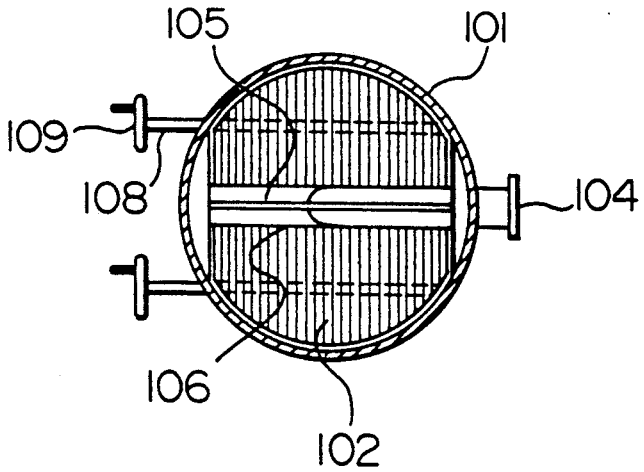
FIG. 15 is a sectional view taken along the line XV—XV of FIG. 12.
Figure 16:
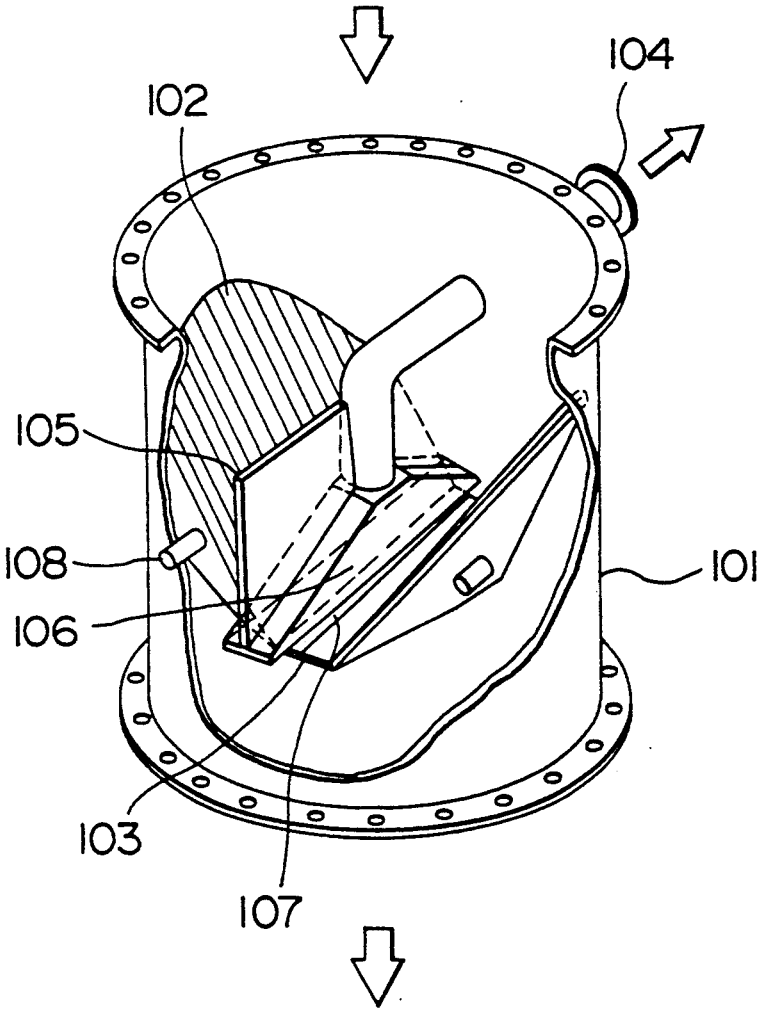
FIG. 16 is a partially fragmentary perspective view of the apparatus of FIG. 12.
Figure 17:
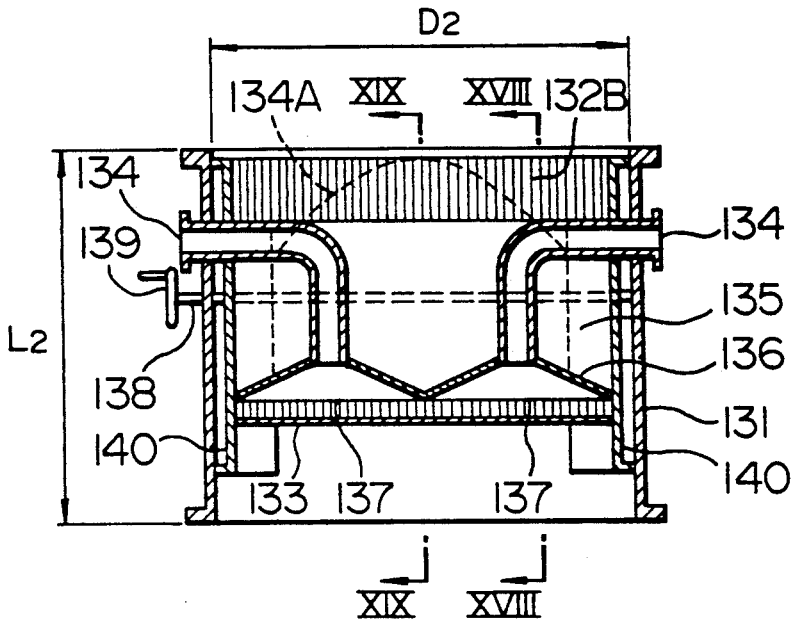
FIG. 17 is a longitudinal sectional view of a further embodiment of the invention.
Figure 18:
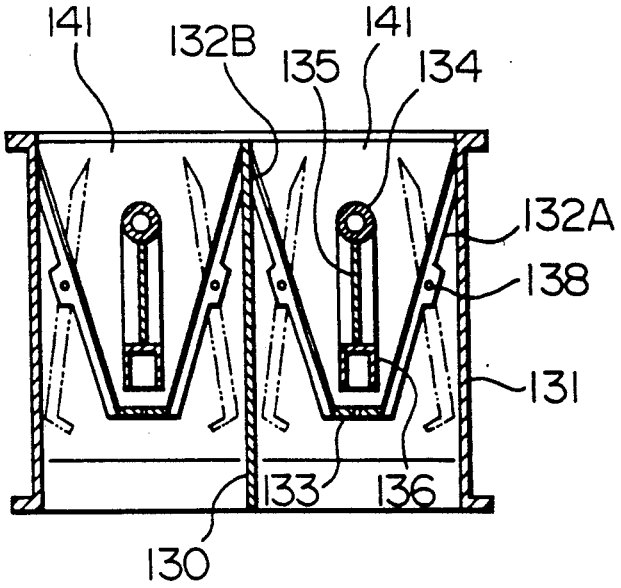
FIG. 18 is a sectional view taken along the line XVIII—XVIII of FIG. 17.
Figure 19:
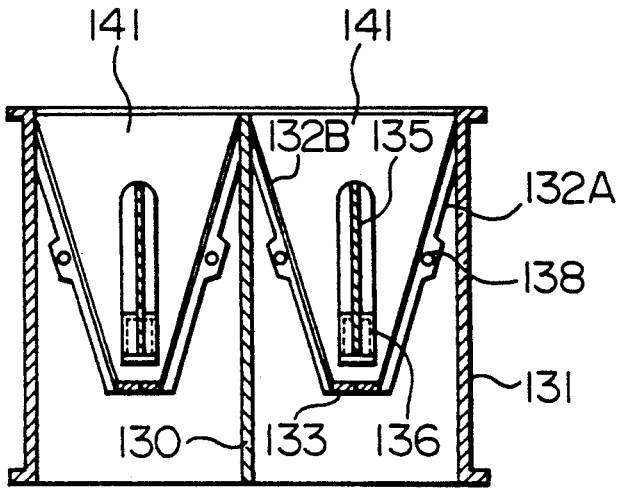
FIG. 19 is a sectional view taken along the line XIX—XIX of FIG. 17.
Figure 20:
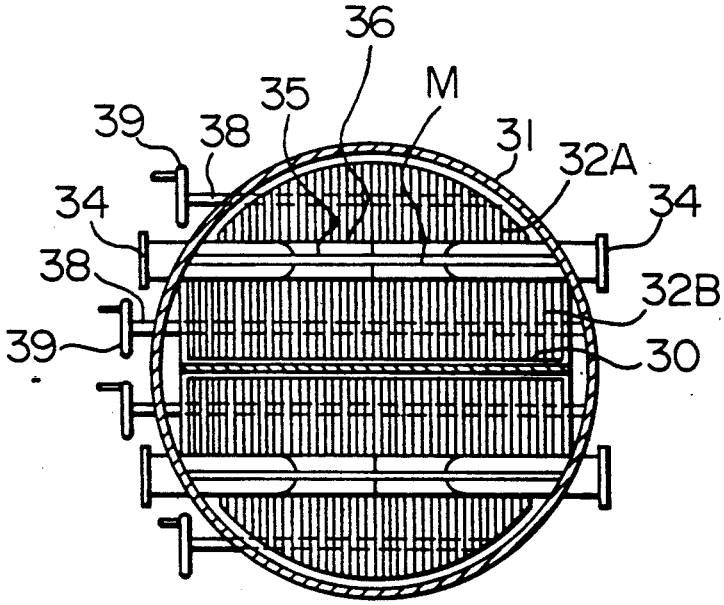
FIG. 20 is a cross-sectional view showing the apparatus of FIG. 17.

When the cooling water having cleaning bodies S, which have passed through the heat transfer tubes of the condenser to perform the washing, is introduced from the upstream side of the barrel 101 through the cooling water discharging pipe, the cleaning bodies S collide with the collection lattices 102, which have been pivoted to the position indicated by solid lines in FIG. 13 by rotating the handle 109, and descend along the crosspieces obliquely provided in the lattices to fall on the cleaning body guide 103. Thereafter, the cleaning bodies S are introduced into the space between the cleaning body guide 103 and the downstream end portion of the downwardly facing suction box 106 and into the downwardly facing suction box 106 through the opening portion 107 to be collected to a predetermined position through the cleaning body discharge pipe 104.

In the case where the large amount of foreign matter is temporarily introduced from the cooling water pipe, the foreign matter having a larger size than the space between the side edges of the downwardly facing suction absorption box 106 and the downstream edges of the collection lattices 102 is trapped between the absorption box 106 and the collection lattices 102. After the cleaning bodies S are introduced only into the cleaning body guide 103, the cleaning bodies S are suctioned into the downwardly facing suction absorption box 106 through the opening portion 107 and are collected to a predetermined position through the cleaning body discharge pipe 104.

FIGS. 17 through 20 show the case where the interior of the barrel 131 is divided into a plurality (two in the drawings) of chambers 141 by a partitioning plate 130 and the cleaning body collection means having the same structure as that shown in FIGS. 12 to 16 is provided in each chamber 141 for the same reason as in the embodiment shown in FIGS. 8 through 11.

Yet another embodiment of the invention will be described with reference to FIGS. 21 to 23 in which an water injection pipe 111 is fixed to the barrel 101 and the cleaning body guide 103 and is opened at its tip end toward the interior of the cleaning body discharge pipe 104. Therefore, according to this embodiment, it is possible to draw the cleaning bodies S, introduced into the downwardly facing suction absorption box 106, into the cleaning body discharge pipe 104 at a higher speed by the injection water flow from the water injection pipe 111. It should be noted that the injected water used in the water injection pipe 111 may be an injected water branched from a recirculation pump outlet of the cleaning body recirculation line or otherwise may be a pressurized cooling water branched from the cooling water pipe upstream of the barrel 101.

Figure 24:
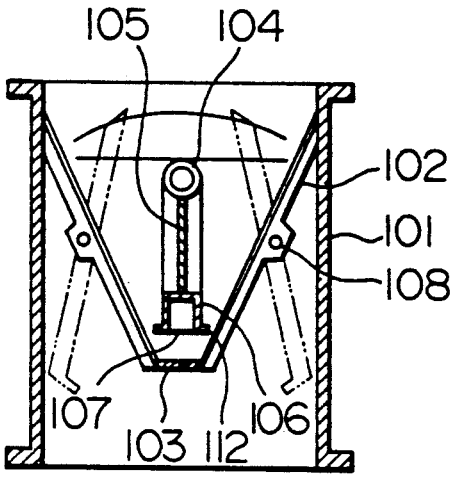
FIG. 24 is a longitudinal sectional view of a still further embodiment of the invention.

As shown in FIG. 24, the downwardly facing suction box 106 in accordance with this embodiment has a flange 112 fixed to an outer surface of the downstream ends of the widthwise direction. The flange 112 has end portions extending toward the downstream side of the collection lattices 102.

Figure 25:
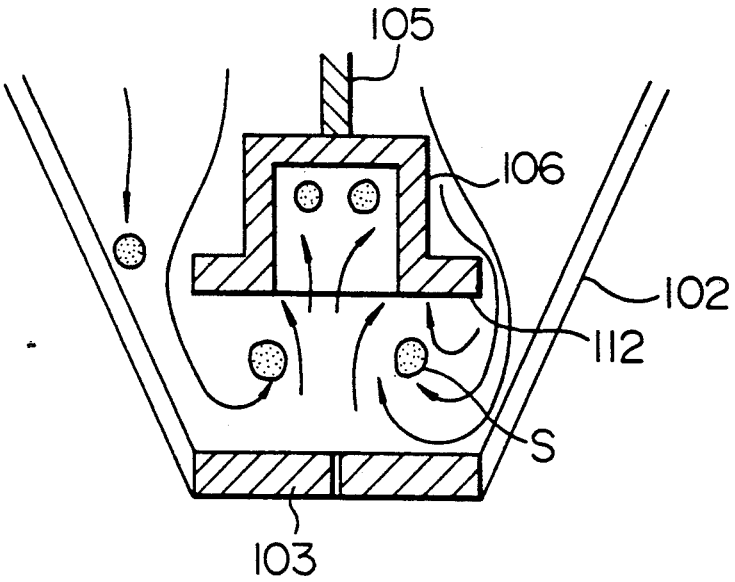
FIG. 25 is an illustration of the operation of the apparatus shown in FIG. 24.

Accordingly, as shown in FIG. 25, the cooling water supplied from the upstream side is switched in eddies by the projection of the flange 112, and the generating of the forcible convection is accelerated on the downstream side of the flange 112. As a result, the cleaning bodies S are effectively entrained or introduced into the downwardly facing suction box 106 to thereby further enhanced the collection performance.

Figure 26:
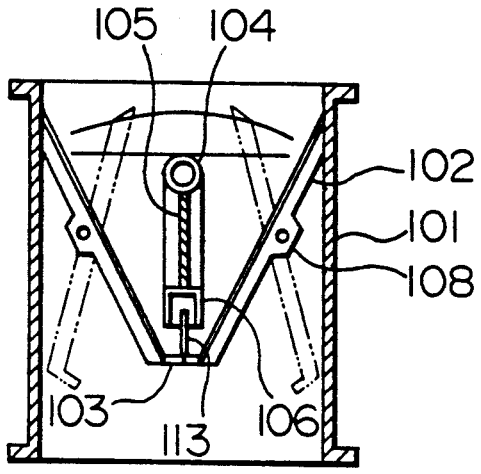
FIG. 26 is a longitudinal sectional view of another embodiment of the invention.

As shown in FIG. 26, in this embodiment, a planar rectifying plate 113 is provided at the central portion in the widthwise direction between the reverse absorption box 106 and the cleaning body guide 103 and is fixed at both sides to the vertical plates (not shown).

Figure 27:
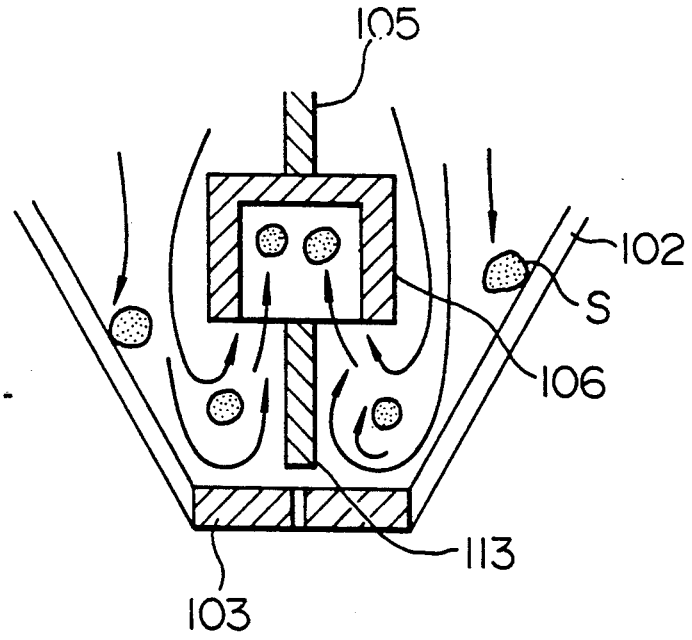
FIG. 27 is an illustration of the operation of the apparatus shown in FIG. 26.

Accordingly, as shown in FIG. 27, the cooling water which has passed from the upstream side through the space between two end faces extending in the widthwise direction of the downwardly facing suction 106 and the downstream side of the collection lattices 102 is accelerated by generation of forcible convection between the downwardly facing suction box 106 and the cleaning body guide 103 by the rectifying plate 113 in the same way as in FIG. 25. As a result, the cleaning bodies S are effectively entrained into the reverse absorption box 106 and are simultaneously drawn therein. It is therefore possible to further enhance the collection property.

Figure 28:
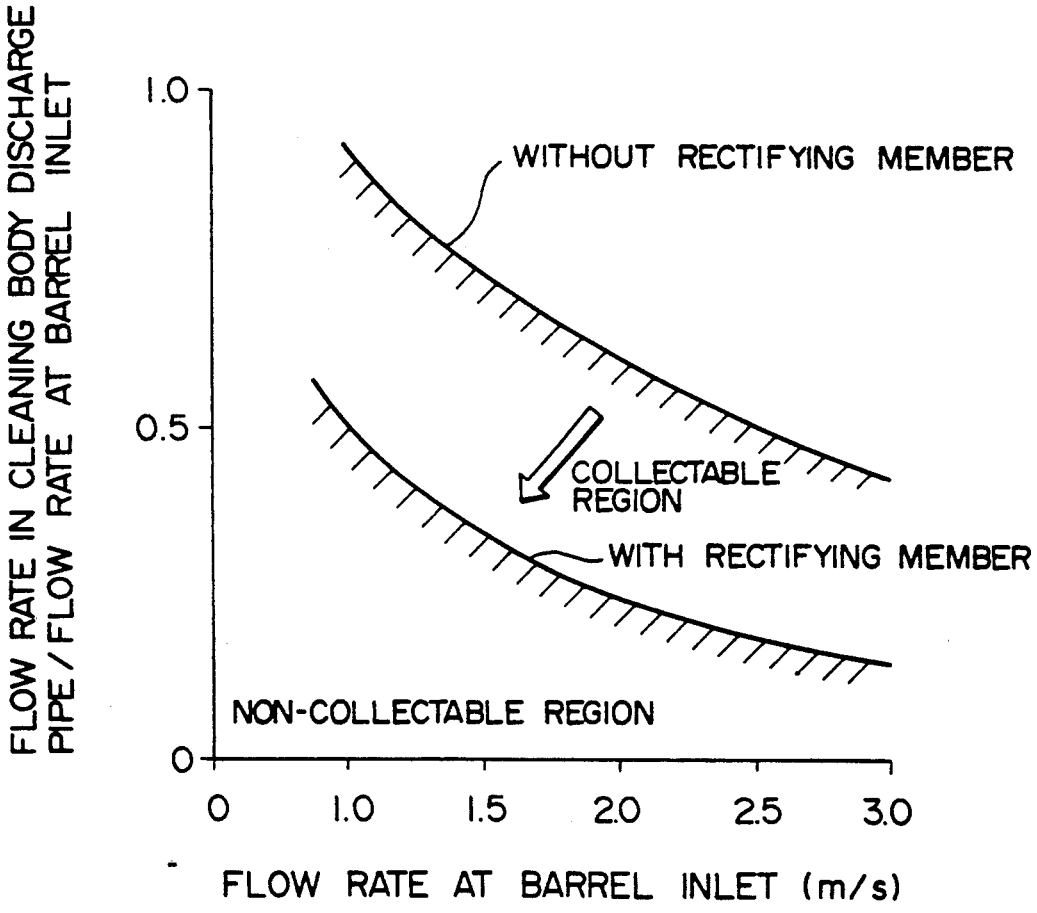
FIG. 28 is a graphical illustration of the characteristics of the cleaning body collection limits in accordance with the presence/absence of the flow rectifying member according to the invention.
Figure 29:
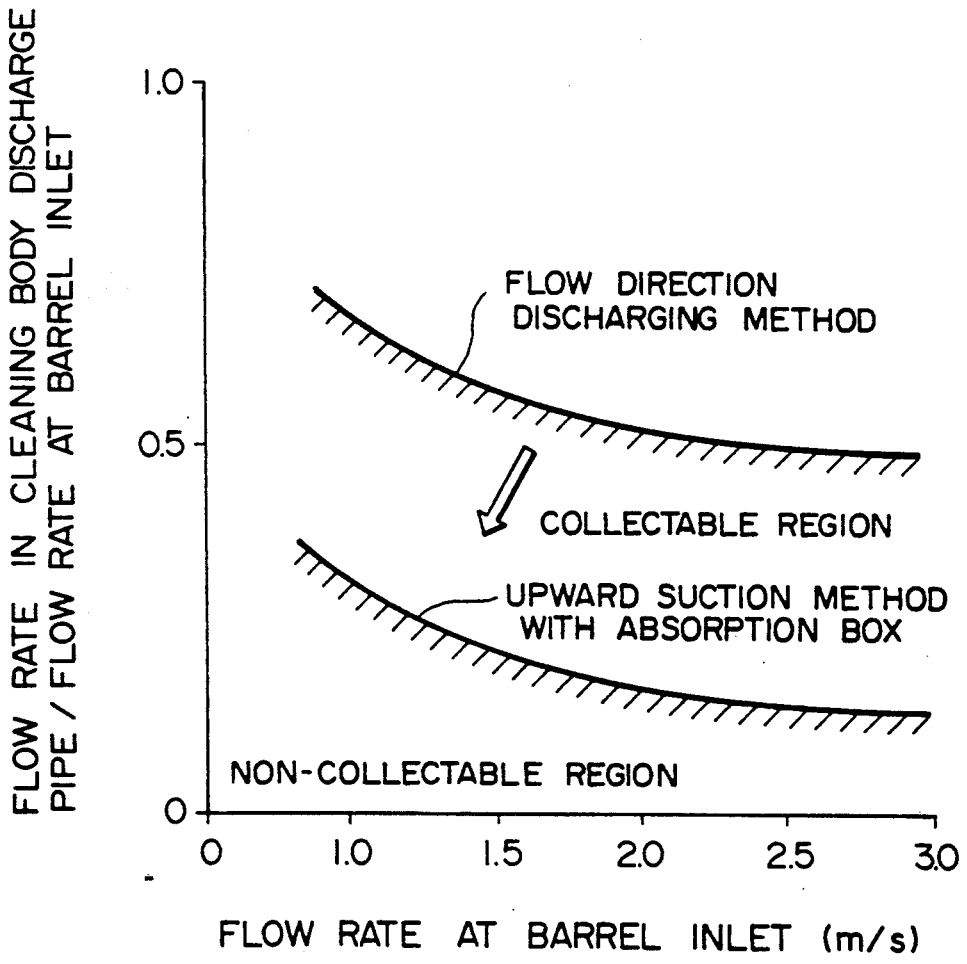
FIG. 29 is a graphical illustration of the characteristics of the cleaning body collection limits in accordance with a difference in cleaning body discharge methods.

On the other hand, according to experimental results, comparing a method of suctioning the cleaning bodies on the upstream side, i.e., upwardly as in the present invention, with a conventional method suctioning the cleaning bodies on the downstream side, i.e., downwardly, it was found that the upwardly suctioning method was superior to the downwardly suctioning method in cleaning body collectable range in the relationship of the flow rate ratio (flow rate of the cleaning body discharge pipe/flow rate of the inlet of the barrel) as shown in FIG. 28.

Figure 21:
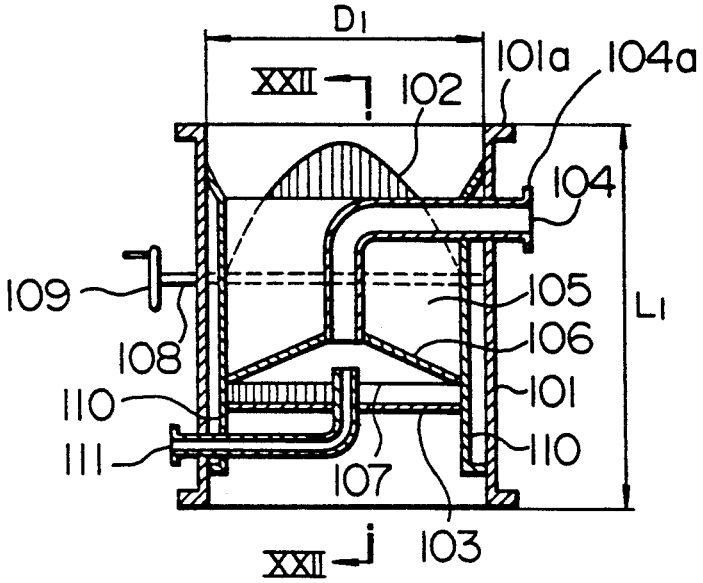
FIG. 21 is a longitudinal sectional view of yet an another embodiment of the invention.
Figure 22:
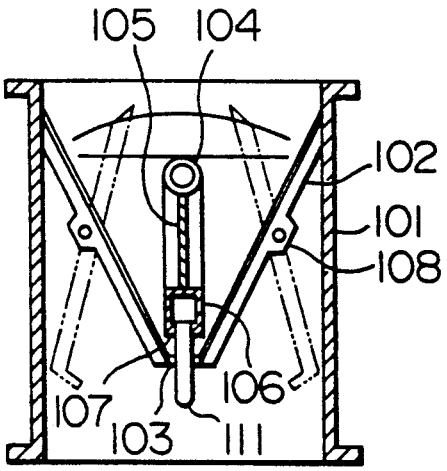
FIG. 22 is a sectional view taken along the line XXII—XXII of FIG. 21.
Figure 23:
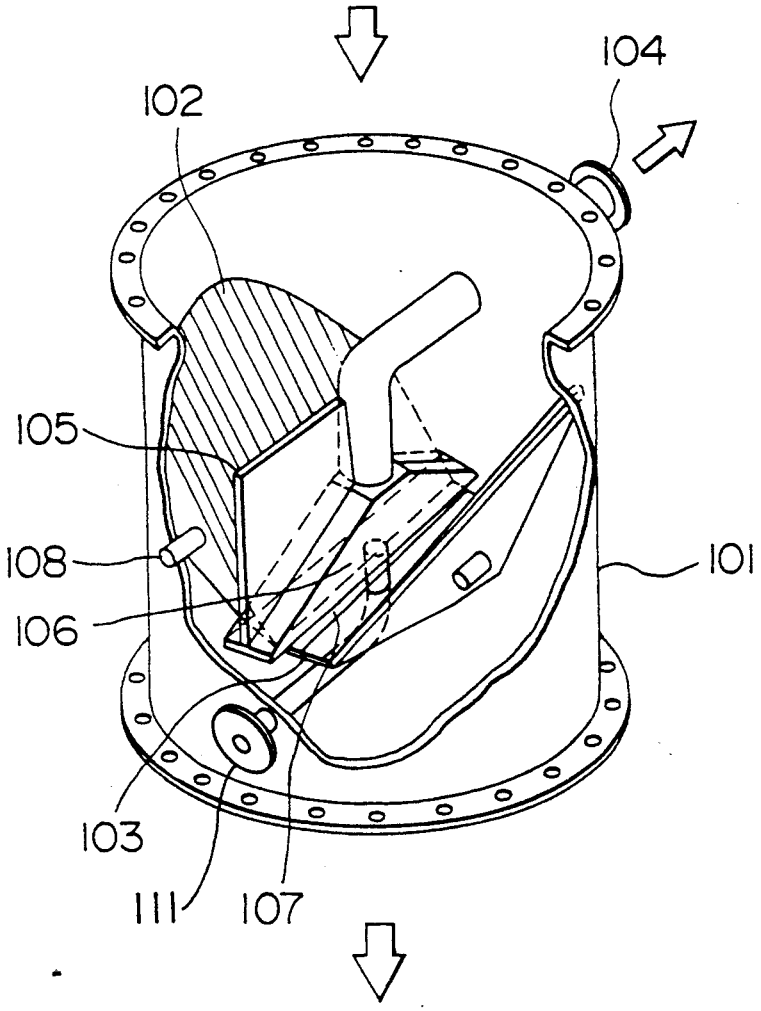
FIG. 23 is a partially fragmentary perspective view showing the apparatus of FIG. 21.

In the embodiment shown in FIGS. 21 and 22, since the water is injected from the water injection pipe 111 when discharging the cleaning bodies upwardly, due to the effect of the injection water flow, the cleaning bodies S are suctioned to the washing material discharge pipe 104 at a higher speed, thereby further enhancing the cleaning body collection performance.

As described above, according to the invention, since the flow rectifying member and a guide member for introducing the cleaning bodies to the cleaning body discharge pipe opened at its downstream end on the downstream pipe are provided at the same time, it is possible to ensure a high cleaning body collection performance.

According to a first aspect of the invention, since it is possible to rectifying or regulate the flow lines of the deflected flow from the upstream side, the cleaning bodies are introduced along the rectifying flow lines, whereby it is possible to ensure the higher collection performance (i.e., higher collection efficiency) without any adhesion or stagnation of the washing materials to the collection lattices.

Also, even if a large amount of foreign matter is introduced temporarily from the upstream side, since the downward end of the cleaning body discharge pipe is opened toward the downward side, there is no fear that the pipe would be clogged by the foreign matter. It is therefore possible to suction only the cleaning bodies upwardly into the cleaning body discharge pipe.

According to a second aspect of the invention, since the collection lattices are pivotally supported, it is possible to readily clean the collection lattices.

According to the third aspect of the invention, the guide member is composed of vanes such that a central portion which is located on the most downward side is fixed to the downstream end of the flow rectifying member, both sides of the vanes extend obliquely on the upstream side and the downstream end of the cleaning body discharge pipe is opened at the central portion toward the downstream side, and a cleaning body guide is arranged downstream of the vanes and substantially in parallel with the vanes at an interval greater than a diameter of the cleaning bodies but less than a size of relatively larger foreign matter. Accordingly, the foreign matter and the like are trapped between the widthwise end faces of the vanes and the collection lattices and only the cleaning bodies are guided along the slant surface of the cleaning body guide between the vanes and the cleaning body guide to the central portion, so that they are introduced into the cleaning body discharge pipe. For this reason, the tip end opening portion of the cleaning body discharge pipe would not be clogged to thereby enhance the collection performance.

According to a fourth aspect of the invention, since the widthwise size of the cleaning body guide is increased toward the ends thereof, it is possible to readily determine the length of the collection lattices. Thus, it is possible to readily fix the downstream edges of the collection lattices and the widthwise end faces of the cleaning body guide and to readily determine the spacing between the widthwise end faces of the cleaning body guide and the vanes.

According to a fifth aspect of the invention, the guide member is composed of a downwardly facing suction box and a cleaning body guide, the downstream side of the downwardly facing suction box is opened downwardly toward the cleaning body guide, and a predetermined spacing is provided between the cleaning body guide and the downwardly facing suction box. Thus, the foreign matter or the like may be trapped, and only the cleaning bodies are allowed to enter into the cleaning body discharge pipe with high efficiency.

According to a sixth aspect of the invention, since the water injection pipe opening toward the downwardly facing suction box is provided between the downwardly facing suction box and the cleaning body guide, it is possible to introduce the cleaning bodies into the cleaning body discharge pipe at a higher speed due to the effect of the injection water flow from the injection water pipe, whereby it is possible to further enhance the cleaning body collecting performance.

According to a seventh aspect of the invention, a flange having an end extending toward the collection lattice is provided on the outer portion of the downstream widthwise edge of the reverse absorption box, so that the generation of the peeling forcible convection is accelerated between the downwardly facing suction box and the cleaning body guide and the cleaning bodies are effectively suctioned and entrained into the downwardly facing suction box to thereby enhance the cleaning body collecting performance.

According to an eighth aspect of the invention, since the flow rectifying or regulating plate for entraining and guiding the cleaning bodies into the box is provided between the downwardly facing suction box and the cleaning body guide, it is possible to accelerate the generation of the peeling forcible convection between the downwardly facing suction box and the cleaning body guide to further enhance the cleaning body collecting performance.

According to a ninth aspect of the invention, the chamber within the barrel is divided into a plurality of chambers by a partition plate in dependence upon the size of the cooling passage, and the respective divided chambers have the same structure as the first aspect of the invention. Thus, it is possible to miniaturize the apparatus.

According to a tenth aspect of the invention, the vanes are wave shaped so that the downstream tip ends of the cleaning body discharge pipes are located on the downstream side, whereby it is possible to facilitate the manufacture of the vanes.

According to the eleventh aspect of the invention, the cleaning body guide is wave shaped so that the position, facing the opening portions of the downstream ends of the cleaning body discharge pipes, of the cleaning body guide is located on the downstream side. It is thus possible to facilitate the manufacture of the cleaning body guide.

What is claimed is:

1. An apparatus for collecting cleaning bodies from a flow stream of a tubular heat exchanger, comprising:

a cleaning body guide having an inlet and an outlet;

a collection lattice means including an upstream end facing said inlet and a donwstream end facing said outlet, said collection lattice means being V-shaped such that a lattice of the collection lattice means converges from said upstream end to said downstream end;

a cleaning body discharge means for removing the cleaning bodies trapped by said collection lattice means from said cleaning body guide, said cleaning body discharge means including an open end facing said outlet and a pipe section extending upstream from said open end within said collection lattice means;

a flow rectifying means dividing the flow stream passing through said collection lattice means and rectifying disturbances in said flow stream to reduce stagnation adjacent to said collection lattice means, said flow rectifying means being fixed to said pipe section of said cleaning body discharge means; and a guide means fixed to said open end of said cleaning body discharge means for guiding the cleaning bodies collection on said collection lattice means to said open end.

2. The apparatus according to claim 1, wherein means are provided for pivotably mounting said collection lattice means in the apparatus.

3. The apparatus according to claim 1, wherein said guide means includes a vane fixed so that a central portion located on a most downstream side is fixed to a downstream end portion of said flow rectifying means, said vane including side portions extending obliquely in an upstream direction, a downstream end of the cleaning body discharge means opens in a direction toward the downstream end of the central portion, said cleaning body guide is provided downstream of said vane and is formed substantially in parallel with said vane at a spacing from said vane, and wherein said spacing is greater than a diameter of said cleaning bodies but less than foreign matter.

4. The apparatus according to claim 3, wherein said vane and said cleaning body guide have an increasing width in a direction toward upstream ends thereof.

5. The apparatus according to claim 1, wherein said guide means includes a downwardly facing suction box fixed to a downstream end portion of said flow rectifying means, said down facing suction box being open at a downstream side and including a bottom portion located at a most upstream side of a central portion and side portions obliquely slanted on the downstream side, and wherein said cleaning body guide is formed substantially in parallel with the downstream end face of said downwardly facing suction box at a spacing greater than a diameter of the cleaning body but less than a diameter of foreign matter.

6. The apparatus according to claim 5, wherein said guide means includes a water injection pipe opening toward the upstream side between said downwardly facing suction box and said cleaning body guide.

7. The apparatus according to claim 5, wherein said downwardly facing suction box includes a flange fixed to an outer portion of a downstream end portion of said downwardly facing suction box, and wherein a tip end portion of said flange extends toward said collection lattice means.

8. The apparatus according to claim 5, wherein said guide means includes a flow rectifying plate disposed between said downwardly facing suction box and said cleaning body guide for introducing said cleaning bodies into said downwardly facing suction box.

9. An apparatus for collecting cleaning bodies from a flow stream of a tubular heat exchanger, comprising:

a cleaning body guide having an inlet and an outlet;

a collection lattice means including an upstream end facing said inlet and a downstream end facing said outlet, said collection lattice means being V-shaped such that a lattice of said collection lattice means converges from said upstream end to said downstream end;

a cleaning body discharge means for removing the cleaning bodies trapped by said collection lattice means from said cleaning body guide, said cleaning body discharge means including an open end facing said outlet and a pipe section extending upstream from said open end within said collection lattice means;

at least one partitioning plate for partitioning said flow stream into a plurality of chambers in dependence upon a size of said flow stream, said collection lattice means including a plurality of collection lattices for collecting the cleaning bodies introduced from the upstream side into the respective chambers;

a plurality of flow rectifying means dividing the flow stream passing through said collection lattice means and rectifying disturbances in said flow stream to reduce stagnation adjacent to said collection lattice means, said flow rectifying means being fixed to said pipe section of said cleaning body discharge means; and a guide means fixed to said open end of said cleaning body discharge means for guiding the cleaning bodies collecting on said collection lattice means to said open end, and wherein said pipe section includes a plurality of cleaning body discharge pipes each being fixed at a downstream end thereof to said guide means and being opened at a tip end opening portion thereof toward the downstream side.

10. The apparatus according to claim 9, wherein said guide means includes a vane, said vane being in the form of a wave so that downstream end portions of said plurality of cleaning body discharge pipes are located on the downstream side.

11. The apparatus according to claim 10, wherein said cleaning body guide is in the form of a wave so that a position of the cleaning body guide facing a downstream tip opening portion of said plurality of cleaning discharge pipes is located on the downstream side.

* * * * *